US008210884B2

(12) United States Patent
Corman et al.

(10) Patent No.: US 8,210,884 B2
(45) Date of Patent: Jul. 3, 2012

(54) ELECTRICAL TERMINAL FOR TERMINATING A WIRE

(75) Inventors: Ned Corman, Harrisburg, PA (US); Uwe Blümmel, Hockenheim (DE); Helge Schmidt, Speyer (DE); Charles D. Copper, Hummelstown, PA (US); Raymond Dennis Boyer, Mechanicsburg, PA (US); David B. Weaver, Landisburg, PA (US); John Wesley Hall, Harrisburg, PA (US); John M. Myer, Millersville, PA (US)

(73) Assignees: Tyco Electronics Corporation, Berwyn, PA (US); Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 12/976,707

(22) Filed: Dec. 22, 2010

(65) Prior Publication Data

US 2012/0094551 A1 Apr. 19, 2012

Related U.S. Application Data

(60) Provisional application No. 61/394,260, filed on Oct. 18, 2010.

(51) Int. Cl.
*H01R 4/10* (2006.01)

(52) U.S. Cl. ..... 439/877

(58) Field of Classification Search ..... 439/877, 439/868, 879–882, 887, 421, 275, 442, 730, 439/406

See application file for complete search history.

(56) References Cited

U.S. PATENT DOCUMENTS

| | | | | |
|---|---|---|---|---|
| 3,878,318 | A | 4/1975 | Ziegler, Jr. et al. | |
| 3,955,044 | A | 5/1976 | Hoffman et al. | |
| 4,142,771 | A | 3/1979 | Barnes et al. | |
| 4,932,906 | A * | 6/1990 | Kaley et al. | 439/857 |
| 5,532,433 | A * | 7/1996 | Endo et al. | 174/84 C |

(Continued)

FOREIGN PATENT DOCUMENTS

| | | |
|---|---|---|
| EP | 0 944 130 A2 | 9/1999 |
| JP | 2010 049941 A | 3/2010 |

OTHER PUBLICATIONS

International Search Report, International Application No. PCT/US2011/001754, International Filing Date Oct. 14, 2011.

*Primary Examiner* — Edwin A. Leon

(57) ABSTRACT

An electrical terminal is provided for terminating a wire. The electrical terminal includes an electrical contact and a crimp barrel extending from the electrical contact. The crimp barrel is configured to be crimped around an end of the wire. The crimp barrel includes a base and opposing side walls that extend from the base. The base and the side walls define an opening of the crimp barrel that is configured to receive the end of the wire therein. The side walls extend outwardly from the base to ends. The side walls include base segments that extend from the base and end segments that extend from the base segments and include the ends. A sealing wing extends from the end of at least one of the side walls. The side walls are configured to be folded over when crimped over the end of the wire such that a gap is defined between the end segment and the base segment of at least one of the side walls. The sealing wing is configured to extend within the gap between the end segment and the base segment of the corresponding side wall when the side walls are crimped over the end of the wire.

20 Claims, 7 Drawing Sheets

U.S. PATENT DOCUMENTS 5,561,267 A 10/1996 Fudoo et al.
7,048,562 B2 5/2006 Lutsch et al.
7,306,495 B2 * 12/2007 Hashimoto et al. ..... 439/877
7,775,842 B2 8/2010 Yamagami
7,938,694 B2 * 5/2011 Hiramitsu et al. ..... 439/851
2007/0155235 A1 7/2007 De Keyser et al.
2010/0144189 A1 6/2010 Watanabe et al.

* cited by examiner

ELECTRICAL TERMINAL FOR TERMINATING A WIRE

CROSS REFERENCE TO RELATED APPLICATIONS

This application is a nonprovisional patent application of, and claims priority to and the benefit of, the filing date of U.S. Provisional Patent Application No. 61/394,260, filed on Oct. 18, 2010 and entitled "Electrical Terminal for Terminating a Wire", which is hereby incorporated by reference in its entirety.

BACKGROUND OF THE INVENTION

The subject matter described and/or illustrated herein relates generally to electrical terminals that terminate wires.

Electrical terminals are often used to terminate the ends of wires. Such electrical terminals typically include an electrical contact and a crimp barrel. The crimp barrel includes an opening that receives an end of the wire therein. The crimp barrel is crimped around the end of the wire to establish an electrical connection between the one or more conductors of the wire and the terminal as well as to mechanically hold the electrical terminal on the wire end. When crimped over the wire end, the crimp barrel establishes an electrical connection between the conductor(s) of the wire and the electrical contact.

Conductors of wires are often fabricated from copper. However, as the cost of copper has risen, aluminum has been considered as an alternative conductor material. However, aluminum is not without disadvantages. For example, one disadvantage of using aluminum as a conductor material is an oxide layer that may build on the exterior surface of the conductor. Such an oxide layer has relatively poor electrical conductivity. Accordingly, the oxide layer must be penetrated to the base material to establish a reliable electrical connection between the conductor and the electrical terminal.

Another disadvantage of aluminum is electrochemical corrosion. Many electrical terminals are used within environments that may expose the terminal and the wire crimped thereto to moisture. For example, electrical terminals are often used within automobiles and other vehicles that operate in salt-aqueous environments. Exposure of a conductor to moisture may cause the conductor to corrode. For example, moisture that infiltrates a crimp interface between a conductor and a crimp barrel may cause the conductor to experience electrochemical corrosion, and thereby begin to dissolve. Moreover, the end of many conductors is exposed at an end of the crimp barrel of the electrical terminal, for example through an opening within the end of the crimp barrel and/or because the end of the conductor extends past the end of the crimp barrel. Such exposed ends of conductors may experience corrosion from exposure to moisture within the operating environment of the electrical terminal. Corrosion is thus an issue when using aluminum as a conductor material. Moreover, the electrical terminal is optionally fabricated from copper based alloyed materials. In the electrochemical series copper and aluminum have a large difference in electrochemical potential, which is an indication for high corrosion speed. Corrosion may therefore be especially problematic when terminating aluminum conductors to copper-based electrical terminals.

A known attempt at prohibiting electrochemical corrosion includes preventing or reducing the exposure of a conductor to moisture. For example, attempts have been made to seal the ends of crimp barrels using silicone gaskets. However, because aluminum has a reduced amount of electrical conductivity relative to copper, aluminum conductors need to have a larger cross-sectional area than copper conductors for a given electrical current carrying capacity. When a copper conductor is replaced with an aluminum conductor, the space occupied by the silicone gasket may prevent the larger aluminum conductor from being used with the existing electrical terminal. A larger crimp barrel and silicone gasket would therefore need to be manufactured to accommodate the larger aluminum conductor, which may increase the cost of an assembly of the electrical terminal and wire.

Another attempt at prohibiting electrochemical corrosion includes decreasing the electrochemical potential between the conductor and the crimp barrel. Decreasing the electrochemical potential is accomplished by fabricating the crimp barrel or surfaces thereof from material which is closer to or substantially the same as the conductor. For aluminum conductors, possible materials of the crimp barrel include nickel plating, aluminum plating, and/or using an aluminum base material for the crimp barrel. However, such techniques are not without disadvantages. For example, nickel plating may require the use of galvanic plating, which may be relatively expensive. Additionally, the relatively hard nickel surface layer may be harmful to the tool used to crimp the crimp barrel around the wire. Moreover, there is a probability that the nickel surface layer will crack during crimping, which would create possible corrosion paths. Aluminum plating is not currently possible with usual plating process and may therefore require the implementation of new plating technology, such as physical vapor deposition (PVD), which may be expensive. Moreover, even with new plating technology such as PVD there will still be exposed edges of the plating layer, which will transfer the corrosion issue to a different place on the electrical terminal.

Fabricating the base material of the crimp barrel out of aluminum material may also be disadvantageous. Some electrical terminals include electrical contacts that are spring beams. However, aluminum has relatively poor spring characteristic properties, so there is no possibility to form a spring beam out of aluminum. Accordingly, fabricating the crimp barrel out of aluminum material would be restricted to use on electrical terminals that do not include a spring beam or it would be necessary to use different materials as the base materials of the crimp barrel and the electrical contacts, which may be expensive, time-consuming, and/or difficult to manufacture.

BRIEF DESCRIPTION OF THE INVENTION

In one embodiment, an electrical terminal is provided for terminating a wire. The electrical terminal includes an electrical contact and a crimp barrel extending from the electrical contact. The crimp barrel is configured to be crimped around an end of the wire. The crimp barrel includes a base and opposing side walls that extend from the base. The base and the side walls define an opening of the crimp barrel that is configured to receive the end of the wire therein. The side walls extend outwardly from the base to ends. The side walls include base segments that extend from the base and end segments that extend from the base segments and include the ends. A sealing wing extends from the end of at least one of the side walls. The side walls are configured to be folded over when crimped over the end of the wire such that a gap is defined between the end segment and the base segment of at least one of the side walls. The sealing wing is configured to extend within the gap between the end segment and the base segment of the corresponding side wall when the side walls are crimped over the end of the wire.

In another embodiment, an electrical terminal is provided for terminating a wire having at least one conductor and an electrical insulation layer. The electrical terminal includes an electrical contact and a crimp barrel extending from the electrical contact. The crimp barrel is configured to be crimped around an end of the wire. The crimp barrel includes a base and opposing side walls that extend from the base. The base and side walls define an opening of the crimp barrel that is configured to receive the end of the wire therein. When the crimp barrel has been crimped around the end of the wire, the side walls and the base of the crimp barrel define a continuous enclosure that extends entirely around a circumference of the end of the wire from the electrical insulation layer of the wire and past an end surface of the at least one conductor.

In another embodiment, an electrical terminal is provided for terminating a wire. The electrical terminal includes an electrical contact and a crimp barrel extending from the electrical contact. The crimp barrel is configured to be crimped around an end of the wire. The crimp barrel includes a base and opposing side walls that extend from the base. The base and side walls define an opening of the crimp barrel that is configured to receive the end of the wire therein. The side walls and base include interior surfaces. An embossment extends outwardly from at least one of the interior surface of the base or the interior surface of at least one of the side walls. The side walls are configured to be folded over when crimped over the end of the wire such that a gap is defined between the end segment and the base segment of at least one of the side walls. The embossment includes a segment that is configured to engage another segment of the embossment within the gap between the end segment and the base segment of the corresponding side wall when the side walls are crimped over the end of the wire.

DETAILED DESCRIPTION OF THE INVENTION

Figure 1:
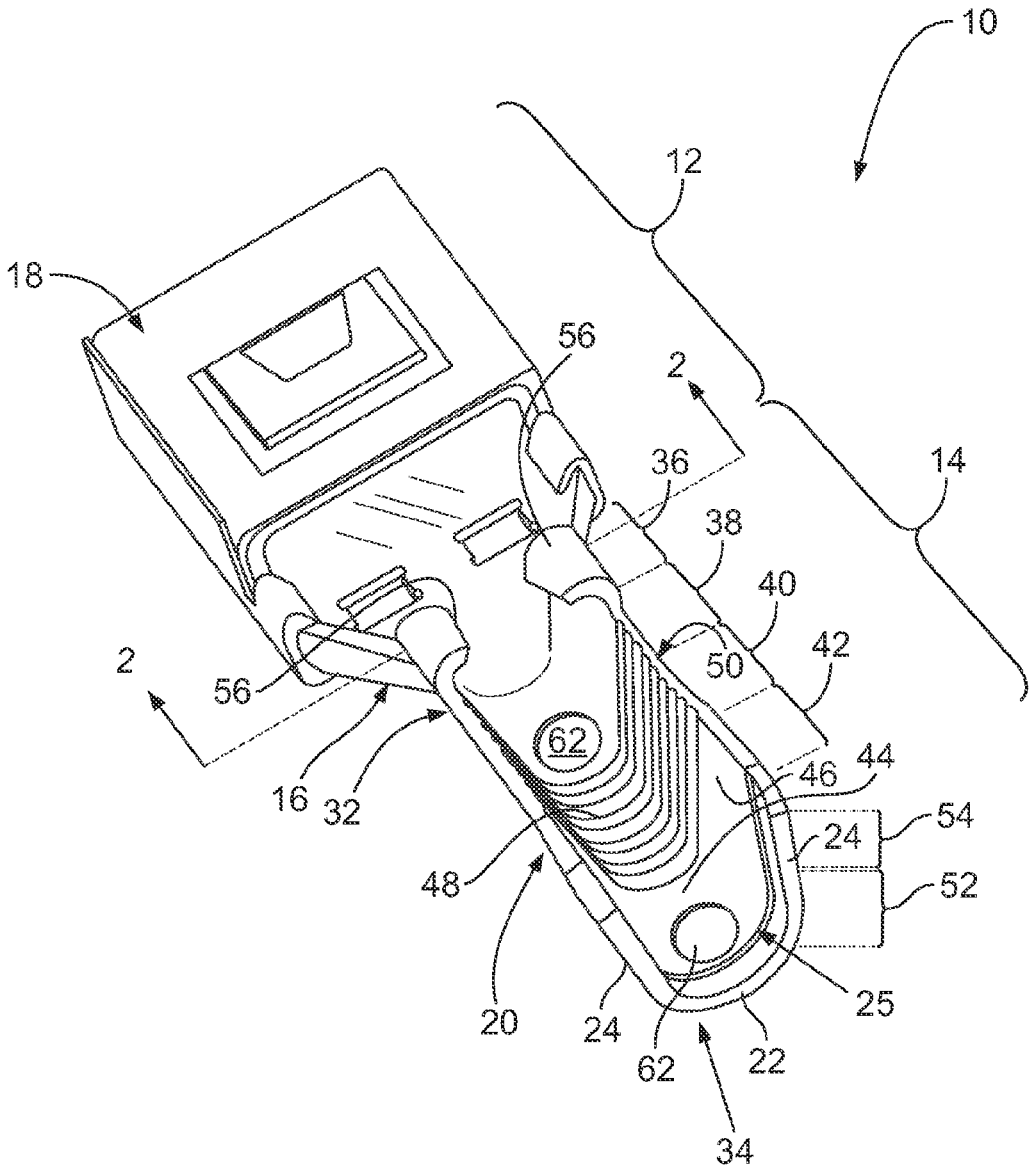
FIG. 1 is a perspective view of an exemplary embodiment of an electrical terminal of the invention.

FIG. 1 is a perspective view of an exemplary embodiment of an electrical terminal 10. The terminal 10 includes an electrical contact segment 12 and a crimp segment 14 that extends from an end 16 of the electrical contact segment 12. The electrical contact segment 12 includes an electrical contact 18. In the exemplary embodiment, the electrical contact 18 is a receptacle that is configured to receive a mating contact (not shown) therein. But, the electrical contact 18 shown herein is meant as exemplary only. The electrical terminal 10 is not limited to the electrical contact 18 shown herein, but rather the electrical terminal 10 may include any type of electrical contact 18, such as, but not limited to, a crimp barrel, a spring contact, a beam contact, a tab, a structure having an opening for receiving a threaded or other type of mechanical fastener, and/or the like.

Figure 5:
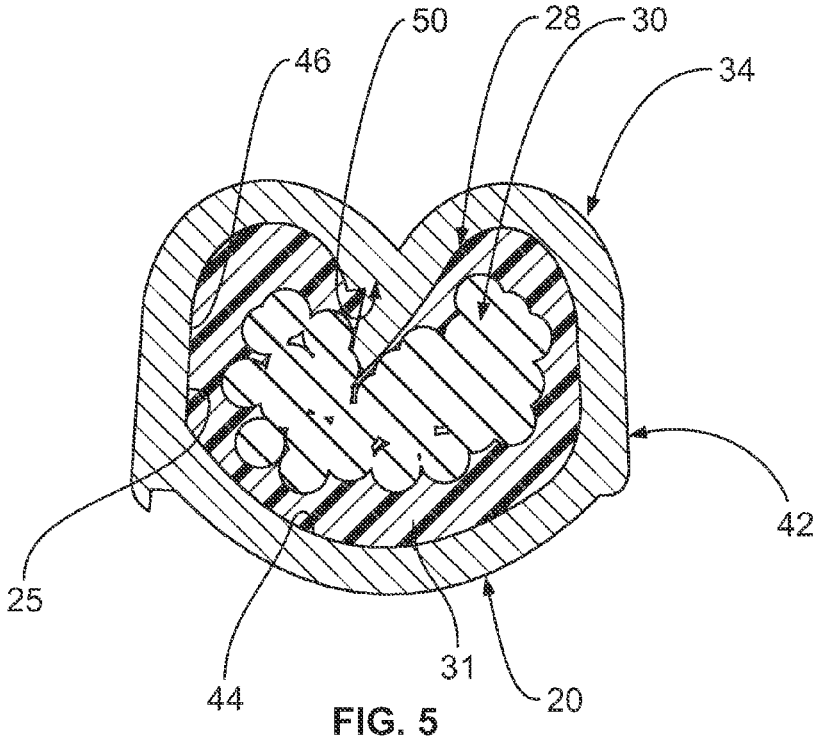
FIG. 5 is another cross-sectional view of the crimp barrel taken along line 5-5 of FIG. 3.
Figure 6:
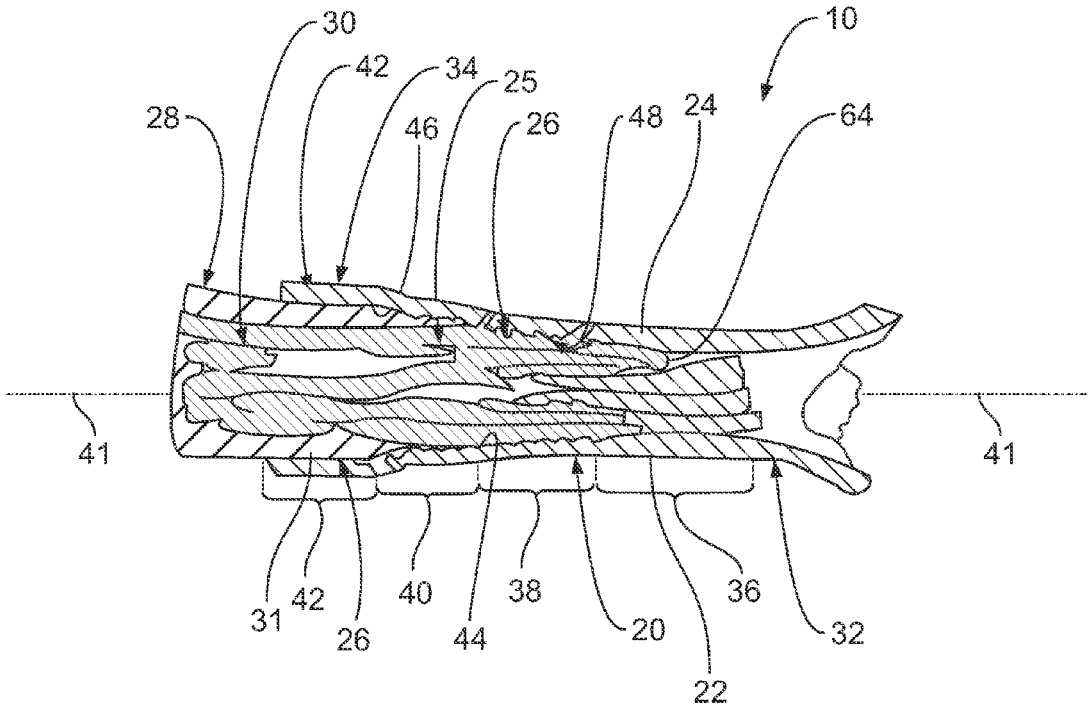
FIG. 6 is a longitudinal cross-sectional view of a portion of the electrical terminal shown in FIG. 4.

The crimp segment 14 includes a crimp barrel 20. The crimp banel 20 includes a base 22 and opposing side walls 24 that extend from the base 22. The base 22 and the side walls 24 define an opening 25 of the crimp banel 20 that is configured to receive an end 26 (FIG. 6) of a wire 28 (FIGS. 3, 5, and 6) that includes one or more conductors 30 (FIGS. 5 and 6). In the exemplary embodiment, the wire 28 includes a plurality of the conductors 30, but the wire 28 may alternatively include only a single conductor 30. In embodiments wherein the wire 28 includes a plurality of conductors 30, the plurality of conductors 30 of the wire 28 may include any number of the conductors 30.

The crimp barrel 20 is configured to be crimped around the end 26 of the wire 28 to mechanically and electrically connect the wire 28 to the electrical terminal 10. The conductors 30 may be any type of conductor. Optionally, the conductors 30 are fabricated from (e.g., may include) aluminum. Additionally or alternatively, the conductors 30 may be fabricated from any other electrically conductive materials, such as, but not limited to, copper and/or the like. Optionally, the wire 28 includes an electrical insulation layer 31 (FIGS. 3, 5, and 6) extending around the conductors 30 along at least a portion of the length of the conductors 30. The electrical insulation layer 31 is optionally removed from at least a portion of ends of the conductors 30 for exposing the conductor ends. In some alternative embodiments, the electrical contact 18 is another crimp barrel 20 that is configured to be crimped around the end of another wire (not shown) to mechanically and electrically connect the other wire to the electrical terminal 10. Accordingly, in some alternative embodiments, the electrical terminal 10 is configured electrically connect the wire 28 to another wire. In other words, the electrical terminal 10 may be used to splice the wire 28 to another wire in some alternative embodiments.

The crimp barrel 20 extends a length from a contact end 32 to a wire end 34. The contact end 32 extends from the electrical contact 18. More particularly, the contact end 32 extends from the end 16 of the electrical contact segment 12. As will be described below, the wire end 34 optionally engages the electrical insulation layer 31 (if provided). The crimp barrel 20 includes a front seal crimp sub-segment 36, an electrical termination crimp sub-segment 38, a compression transition sub-segment 40, and a rear seal sub-segment 42. Generally, the front seal crimp sub-segment 36 provides a seal at the contact end 32 of the crimp barrel 20, while the electrical termination crimp sub-segment 38 engages the conductors 30 to electrically connect the crimp barrel 20 to the conductors 30. The rear seal sub-segment 42 provides a seal at the wire end 34 of the crimp barrel 20.

In the exemplary embodiment, the base 22 and the side walls 24 extend along and define the entirety of the length of the crimp barrel 20. Accordingly, the base 22 and the side walls 24 include the sub-segments 36, 38, 40, and 42 in the exemplary embodiment. The base 22 includes an interior surface 44, and each of the side walls 24 includes an interior surface 46. The interior surfaces 44 and 46 define boundaries of the opening 25 of the crimp barrel 20. Optionally, the interior surfaces 44 and/or 46 include one or more serrations 48, as will be described below.

Prior to crimping, the side walls 24 extend outwardly from the base 22 to corresponding ends 50. More particularly, the side walls 24 include base segments 52 that extend from the base 22 and end segments 54 that extend from the base segments 52 and include the ends 50. At the front seal crimp sub-segment 36, sealing wings 56 extend from the ends 50 of the side walls 24. As will be described below, the sealing wings 56 are configured to extend within a gap 58 (FIG. 4) between the end segment 54 and the base segment 52 of the corresponding side wall 24 when the side walls 24 are crimped over the end 26 of the wire 28.

Figure 2:
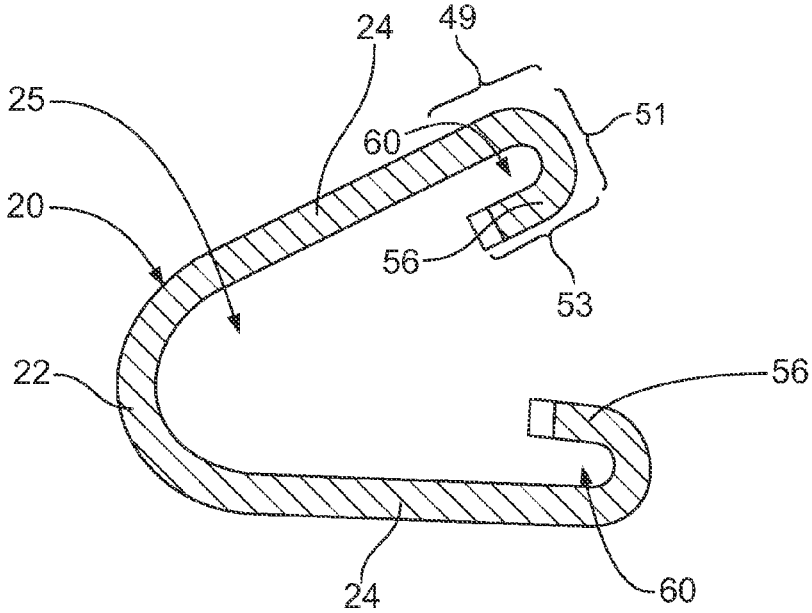
FIG. 2 is a cross-sectional view of a crimp barrel of the electrical terminal shown in FIG. 1 taken along line 2-2 of FIG. 1.
Figure 3:
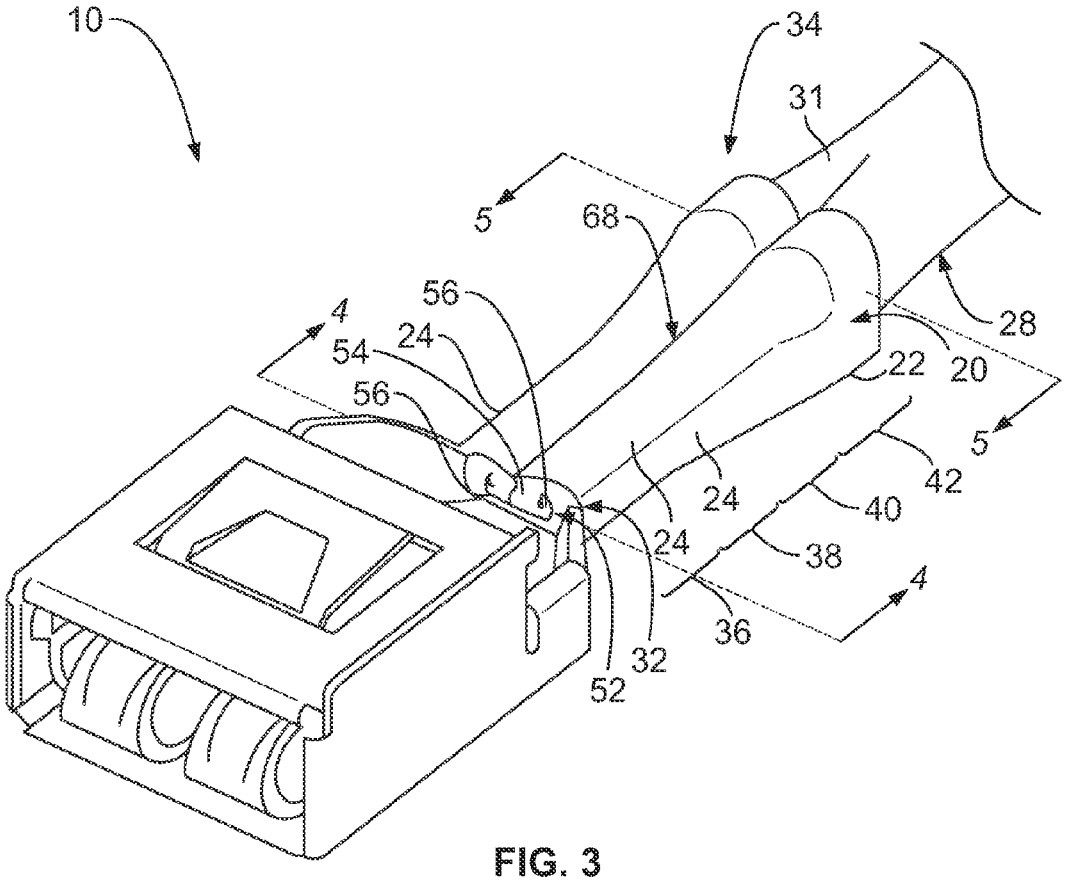
FIG. 3 is a perspective view of the electrical terminal shown in FIG. 1 illustrating the electrical terminal after the crimp barrel has been crimped around the end of a wire.

FIG. 2 is a cross-sectional view of the crimp barrel 20 taken through the front seal crimp sub-segment 36 before the crimp barrel 20 has been crimped around the wire end 26 (FIG. 6). Optionally, one or more of the sealing wings 56 includes a base segment 49 that extends from the end 50 of the corresponding side wall 24 before the side walls 24 are crimped over the end 26 of the wire 28 (FIGS. 3, 5, and 6). One or more of the sealing wings 56 optionally includes a bend segment 51 extending from the corresponding base segment 49, wherein the bend segment 51 is optionally generally U-shaped and optionally extends into the opening 25 of the crimp barrel 20 and/or in a direction generally toward the opening 25 of the crimp barrel 20 before the side walls 24 are crimped over the wire end 26. In the exemplary embodiment, the sealing wings 56 include optional end segments 53 that extend from the corresponding bend segment 51. Optionally, the end segment 53 of one or more of the sealing wings 56 extends approximately parallel to the corresponding side wall 24 before the side walls 24 are crimped over the wire end 26. Moreover, before the side walls 24 are crimped over the wire end 26, one or more of the end segments 53 optionally extends from the corresponding bend segment 51 in a direction generally toward the base 22 of the crimp barrel 20, optionally extends from the corresponding bend segment 51 into the opening 25 of the crimp barrel 20, and/or optionally extends from the corresponding bend segment 51 in a direction generally toward the opening 25 of the crimp barrel 20. An optional pocket 60 is defined between one or more of the sealing wings 56 and the corresponding side wall 24 before the side walls 24 are crimped over the wire end 26. Although two are shown, the crimp barrel 20 may include any number of the sealing wings 56. Moreover, any number of sealing wings 56 may extend from each side wall 24. Each sealing wing 56 may include any sizes, shapes, and/or the like that enable the sealing wing 56 to function as described and/or illustrated herein.

Referring again to FIG. 1, a sealant 62 is optionally provided within the opening 25 of the crimp barrel 20 before the crimp barrel 20 is crimped around the wire end 26 (FIG. 6). For example, the sealant 62 may be provided on the interior surface 44 of the base 22 (as is shown in the exemplary embodiment of FIG. 1) and/or on the interior surface 46 of one or more of the side walls 24. In addition or alternative to the sealant 62, sealant (not shown) is optionally provided within one or more of the pockets 60 (FIG. 2) before the crimp barrel 20 is crimped around the wire end 26. The sealant 62 provided within the opening 25 and/or the sealant provided within a pocket 60 may be any type of sealant, such as, but not limited to, a grease, a lacquer, a gel, a fat, and/or the like.

FIG. 3 is a perspective view of the electrical terminal 10 illustrating the electrical terminal 10 after the crimp barrel 20 has been crimped around the end 26 (FIG. 6) of the wire 28. As can be seen in FIG. 3, the side walls 24 have been crimped over the wire end 26 such that the side walls 24 are folded over. The crimp barrel 20 is crimped along sub-segments 36, 38, 40, and 42 such that when crimped, a seal is formed along the length of the crimp barrel 20, as will be described in more detail below.

Figure 4:
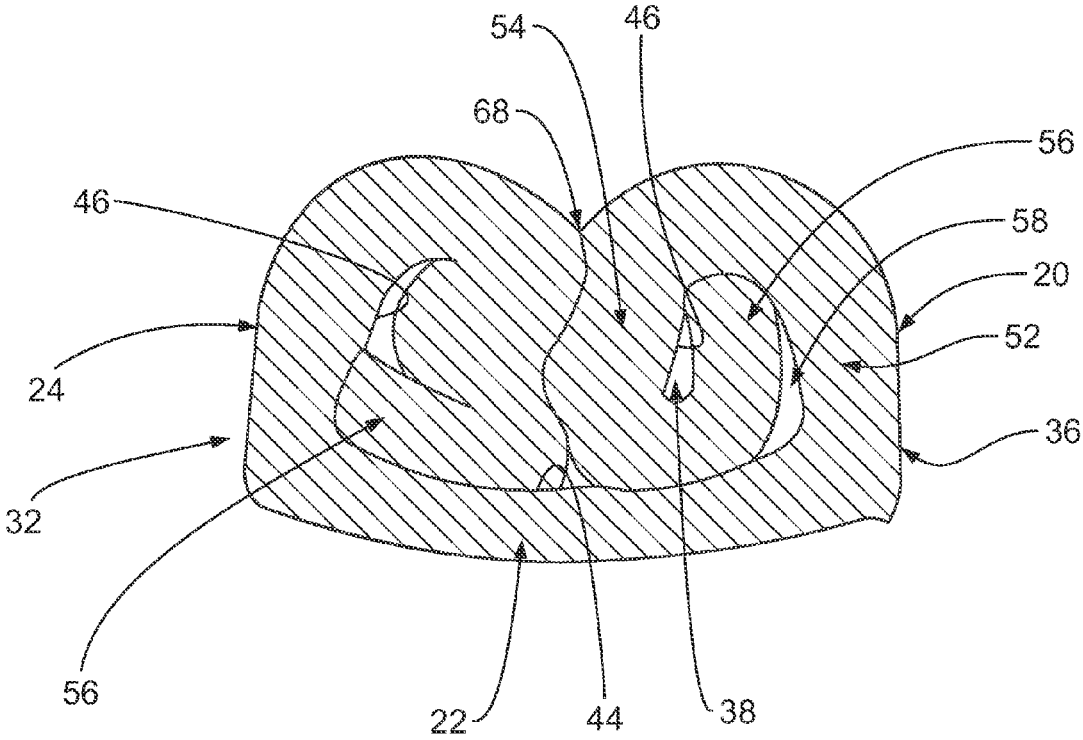
FIG. 4 is a cross-sectional view of the crimp barrel taken along line 4-4 of FIG. 3.

FIG. 4 is a cross-sectional view of the crimp barrel 20 taken through the front seal crimp sub-segment 36 after the crimp barrel 20 has been crimped around the wire end 26 (FIG. 6). When folded over, the gap 58 is defined between the end segment 54 and the base segment 52 of each side wall 24. When the side walls 24 have been crimped over the wire end 26, the sealing wings 56 extend within the corresponding gap 58. The sealing wings 56 thereby facilitate sealing the gaps 58 to facilitate preventing moisture from entering the opening 25 of the crimp barrel 20 through the contact end 32 after the crimp barrel 20 has been crimped over the wire end 26. Optionally, one or more of the sealing wings 56 extends from the corresponding side wall 24 in a direction generally away from the base 22 of the crimp barrel 20 after the side walls 24 have been crimped over the wire end 26. The sealing wings 56 optionally engage the interior surface 46 of base segment 52 and/or the end segment 54 of the corresponding side wall 24 when the side walls 24 are crimped over the wire end 26. As can be seen in FIG. 4, when the side walls 24 have been crimped over the wire end 26 such that the side walls 24 are folded over (e.g., as shown in FIG. 4), the end segments 54 of the side walls 24 are engaged with each other.

Optionally, sealant extends within one or more of the gaps 58 after the side walls 24 have been crimped over the wire end 26 to facilitate sealing the gaps 58. For example, the sealant 62 (FIG. 1) and/or the sealant (not shown) provided within the pocket(s) 60 (FIG. 2) may extend within one or more of the gaps 58 after the side walls 24 have been crimped over the wire end 26.

The sealing wings 56 and/or a combination of the sealing wings 56 and the sealant (the sealant 62 and/or the sealant provided within the pockets 60(*s*)) facilitates sealing the contact end 32 of the crimp barrel 20 to thereby facilitate preventing moisture from entering the opening 25, from contacting the conductors 30 and/or the interior surfaces 44 and/or 46 of the crimp barrel 20, from entering an interface between the conductors 30 and the interior surfaces 44 and/or 46 of the crimp barrel 20, and/or the like. In some embodiments, no portion of the conductors 30 of the wire 28 is exposed through the contact end 32 of the crimp barrel 20 when the crimp barrel 20 has been crimped around the wire end 26.

Referring again to FIG. 3, optionally, no portion of the conductor(s) 30 extends past the contact end 32 of the crimp barrel 20 after the crimp barrel 20 has been crimped around the wire end 26 (FIG. 6). The sealing provided by the sealing wings 56 and/or the sealant (the sealant 62 (FIG. 1) and/or the sealant provided within the pockets 60 (FIG. 2)) thereby facilitates preventing moisture from contacting the conductor(s) 30 as compared to terminals wherein a conductor end sticks out past the contact end of a crimp barrel and/or terminals wherein a conductor is exposed through an opening within the contact end of a crimp barrel.

FIG. 5 is a cross-sectional view of the crimp barrel 20 taken through the rear seal crimp sub-segment 42 after the crimp barrel 20 has been crimped around the end 26 (FIG. 6) of the wire 28. When the crimp barrel 20 has been crimped around the end 26 of the wire 28, the interior surfaces 44 and 46 of the crimp barrel 20 and the ends 50 of the side walls 24 engage (directly or indirectly with the sealant described below) the electrical insulation layer 31 that surrounds the conductor(s)

30. The engagement between the crimp barrel 20 and the electrical insulation layer 31 seals the rear seal crimp sub-segment 42, and more particularly the wire end 34, of the crimp barrel 20 to the electrical insulation layer 31 of the wire 28. The rear seal crimp sub-segment 42 thereby facilitates preventing moisture from entering the opening 25 of the crimp barrel 20 through the wire end 34 after the crimp barrel 20 has been crimped over the wire end 26. Optionally, sealant extends between the crimp barrel 20 and the electrical insulation layer 31 after the crimp barrel 20 has been crimped around the wire end 26 to facilitate sealing the wire end 34. For example, the sealant 62 (FIG. 1) may extend between the crimp barrel 20 and the electrical insulation layer 31 after the crimp barrel 20 has been crimped around the wire end 26. The rear seal crimp sub-segment 42 and/or a combination of the rear seal crimp sub-segment 42 and the sealant facilitates sealing the wire end 34 of the crimp barrel 20 to thereby facilitate preventing moisture from entering the opening 25, from contacting the conductor(s) 30 and/or the interior surfaces 44 and/or 46 of the crimp barrel 20, from entering an interface between the conductor(s) 30 and the interior surfaces 44 and/or 46 of the crimp barrel 20, and/or the like.

FIG. 6 is a longitudinal cross-sectional view of a portion of the electrical terminal 10 taken through the length of the electrical terminal 10 after the crimp barrel 20 has been crimped around the wire end 26. As can be seen in FIG. 6, when the crimp barrel 20 has been crimped around the end 26 of the wire 28, the electrical termination crimp sub-segment 38 of the crimp barrel 20 is engaged with the conductors 30 to thereby electrically connect the conductors 30 to the crimp barrel 20. Optionally, the crimp barrel 20 includes the serrations 48, which may penetrate an oxide layer (not shown) that has built up on the conductors 30. The compression transition sub-segment 40 optionally tapers outwardly as the sub-segment 40 extends toward the rear seal sub-segment 42. More particularly, and as can be seen in FIG. 6, the compression transition sub-segment 40 optionally tapers radially outwardly relative to a central longitudinal axis 41 of the crimp barrel 20. The optional taper of the compression transition sub-segment 40 may allow a smooth transition of the wire end 26 from the uncompressed to the fully compressed condition and/or may accommodate the larger diameter of the wire 28 at the electrical insulation layer 31.

Referring now to FIG. 3, when the crimp barrel 20 has been crimped around the wire end 26 (FIG. 6), the side walls 24 and the base 22 of the crimp barrel 20 define a continuous enclosure that extends entirely around the circumference of the end 26 of the wire 28 from the electrical insulation layer 31 and past end surfaces 64 (FIG. 6) of the conductors 30 (FIGS. 5 and 6). In other words, the side walls 24 and the base 22 of the crimp barrel 20 define a continuous enclosure that extends entirely around the circumference of the wire end 26 from the contact end 32 to the wire end 34 of the crimp barrel 20. In the exemplary embodiment, the side walls 24 and the base 22 of the crimp barrel 20 extend continuously from the contact end 32 to the wire end 34 of the crimp barrel 20 to define the continuous enclosure. An interface 68 (also shown in FIG. 4) between the side walls 24 is sealed by the engagement between the end segments 54 of the side walls 24, which are engaged with each other along an entirety of the length of the crimp barrel 20 from the contact end 32 to the wire end 34. In some embodiments, no portion of the conductors 30 of the wire 28 is exposed between the contact end 32 and the wire end 34 of the crimp barrel 20 when the crimp barrel 20 has been crimped around the end 26 of the wire 28. The continuous enclosure facilitates sealing the crimp barrel 20 to thereby facilitate preventing moisture from entering the opening 25, from contacting the conductors 30 and/or the interior surfaces 44 and/or 46 of the crimp barrel 20, from entering an interface between the conductor(s) 30 and the interior surfaces 44 and/or 46 of the crimp barrel 20, and/or the like.

Figure 7:
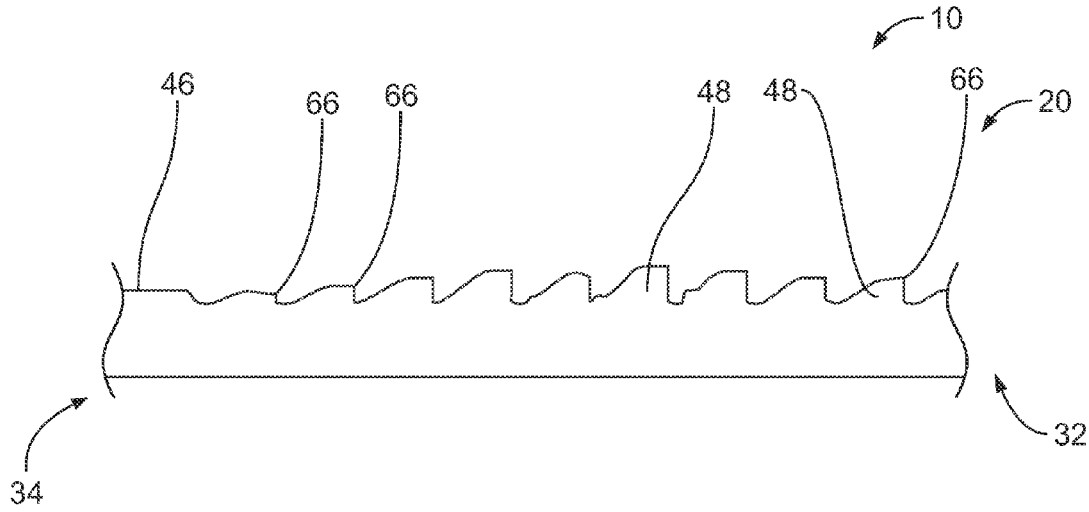
FIG. 7 is a cross-sectional view of a portion the crimp barrel of the electrical terminal shown in FIG. 1 illustrating an exemplary embodiment of serrations of the crimp barrel.

FIG. 7 is a cross-sectional view of a portion of the crimp barrel 20 of the electrical terminal 10 illustrating an exemplary embodiment of the serrations 48. As described above, the interior surfaces 44 and/or 46 of the crimp barrel 20 optionally include one or more serrations 48. The serrations 48 may be used to penetrate an oxide layer on the conductors 30 (FIGS. 5 and 6) during crimping of the crimp barrel 20 around the wire end 26 (FIG. 6). The serrations 48 thereby facilitate establishing a reliable electrical connection between the crimp barrel 20 and the conductors 30. As can be seen in FIG. 7, a cutting edge 66 of each serration 48 generally faces, or points to, the contact end 32 of the crimp barrel 20. In other words, the cutting edges 66 generally face, or point, away from the wire end 34 of the crimp barrel 20. In addition or alternative to facing the cutting edges toward the contact end 32 of the crimp barrel 20, the cutting edges 66 of serrations 48 that are closer to the contact end 32 of the crimp barrel 20 may be sharper than the cutting edges 66 of some or all of the serrations 48 that are closer to the wire end 34 of the crimp barrel 20. For example, beginning with the serration 48 that extends closest to the contact end 32 and moving toward the wire end 34, each subsequent serration 48 optionally includes a cutting edge 66 that is less sharp than the cutting edge 66 of the previous serration 48. The cutting edges 66 may facilitate avoiding mechanical disturbance of the conductor(s) 30 that would otherwise be caused by cuts from the cutting edges of at least some known serrations (not shown). The crimp barrel 20 may include any number of the serrations 48.

Figure 8:
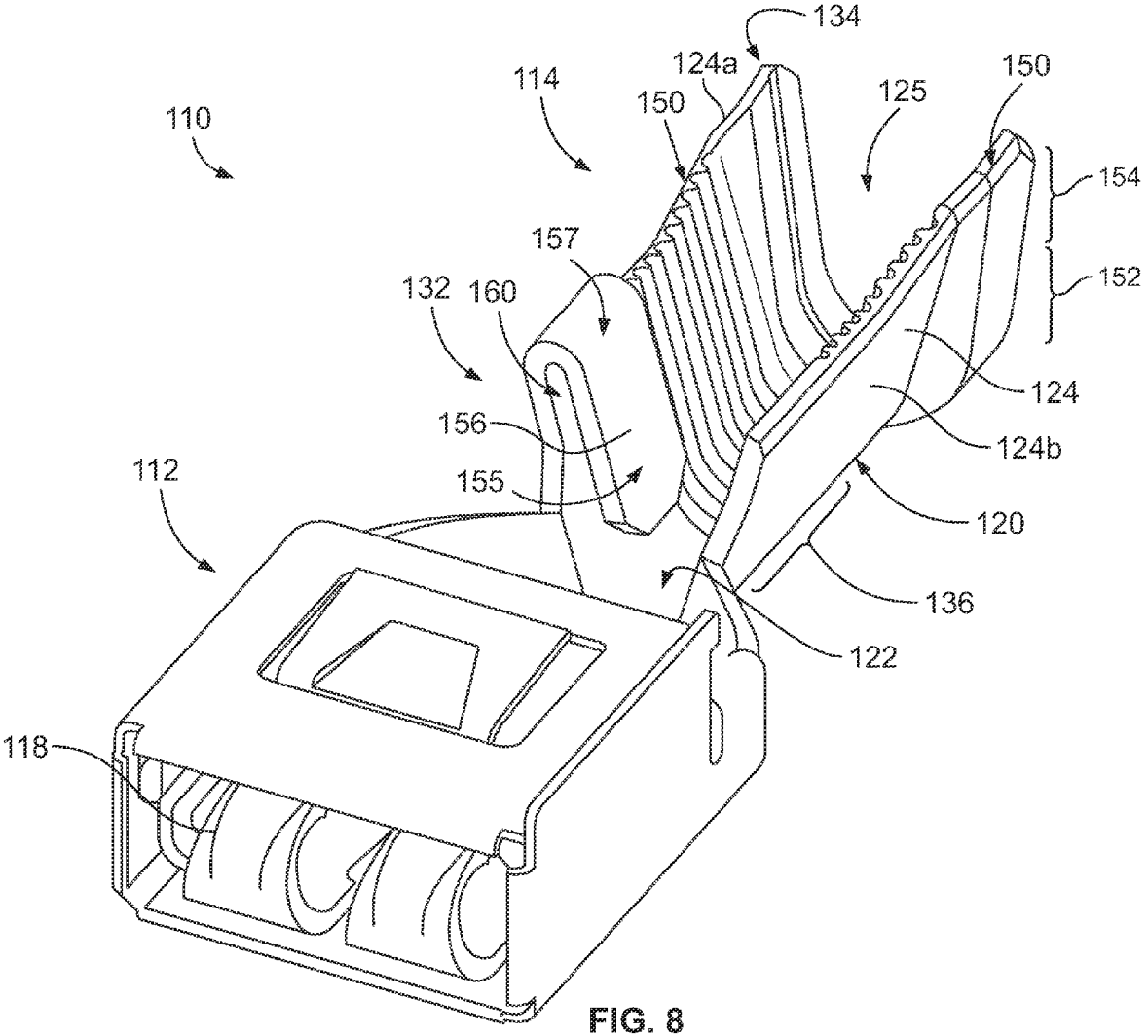
FIG. 8 is a perspective view of an exemplary alternative embodiment of an electrical terminal.

Referring again to FIG. 1, in the exemplary embodiment of the electrical terminal 10 the crimp barrel 20 includes two sealing wings 56. But, as described above, the crimp barrel 20 may include any number of the sealing wings 56. For example, FIG. 8 is a perspective view of an exemplary alternative embodiment of an electrical terminal 110 illustrating a crimp barrel 120 that includes a single sealing wing 156. The terminal 110 includes an electrical contact segment 112 and a crimp segment 114 that extends from the electrical contact segment 112. The electrical contact segment 112 includes an electrical contact 118.

The crimp segment 114 includes the crimp barrel 120, which is configured to be crimped around the end 26 (FIG. 6) of the wire 28 (FIGS. 3, 5, and 6) to mechanically and electrically connect the wire 28 to the electrical terminal 110. The crimp barrel 120 includes a base 122 and opposing side walls 124 that extend from the base 122. An opening 125 of the crimp barrel 120 is defined between the base 122 and the side walls 124. The crimp barrel 120 extends a length from a contact end 132 to a wire end 134 and includes a front seal crimp sub-segment 136. Prior to crimping, the side walls 124 extend outwardly from the base 122 to corresponding ends 150. More particularly, the side walls 124 include base segments 152 that extend from the base 122 and end segments 154 that extend from the base segments 152 and include the ends 150.

At the front seal crimp sub-segment 136, the sealing wing 156 extends from the end 150 of one of the side walls **124*a*. Optionally, the sealing wing 156 includes a base segment 157 that extends from the end 150 of the side wall 124*a*. The base segment 157 of the sealing wing 156 optionally includes a bend segment, which optionally is generally U-shaped, optionally extends into the opening 125 of the crimp barrel 20, and/or optionally extends in a direction generally toward the opening 125 before the side walls 124 are crimped over the wire end 26. In the exemplary embodiment, the sealing wing 156 includes an optional end segment 155 that extends from the bend segment of the base segment 157. Optionally, the end segment 155 of the sealing wing 156 extends from the base segment 157 in a direction generally toward the base 122 of the crimp barrel 120 before the side walls 124 are crimped over the end 26 of the wire 28. The end segment 155 of the sealing wing 156 optionally extends from the base segment 157 into the opening 125 of the crimp barrel 120 and/or in a direction generally toward the opening 125 of the crimp barrel 20 before the side walls 124 are crimped over the wire end 26. Optionally, at least a portion of the end segment 155 of the sealing wing 156 extends approximately parallel to the side wall 124***a* before the side walls 124 are crimped over the wire end 26. An optional pocket 160 is defined between the sealing wing 156 and the side wall 124*a* before the side walls 124 are crimped over the wire end 26.

Figure 9:
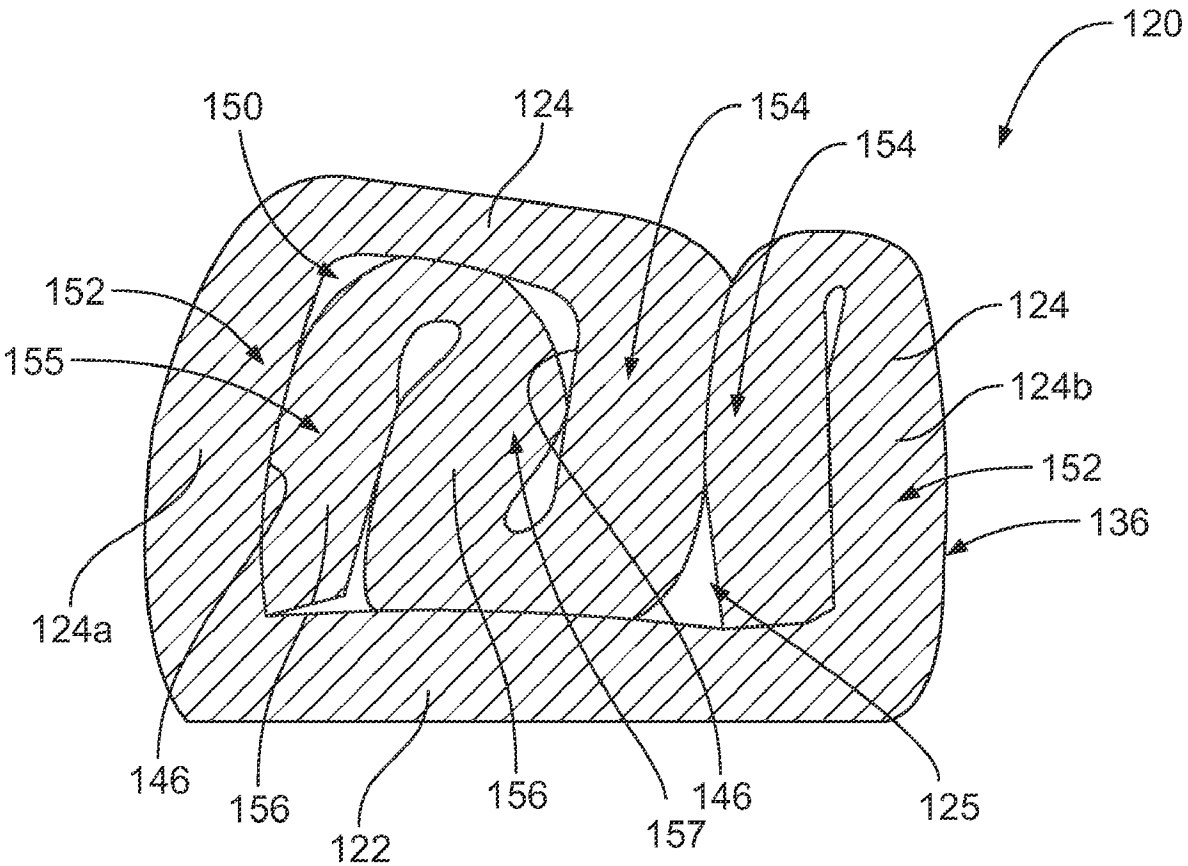
FIG. 9 is a cross-sectional view of the electrical terminal shown in FIG. 8 after an exemplary embodiment of a crimp barrel of the electrical terminal has been crimped around the wire end.

FIG. 9 is a cross-sectional view of the crimp barrel 120 taken through the front seal crimp sub-segment 136 after the crimp barrel 120 has been crimped around the wire end 26. The side walls 124 have been crimped over the wire end 26 (FIG. 6) such that the side walls 124 are folded over. When folded over, the end segment 154 of the side wall 124*b* is engaged with the base segment 152 of the side wall 124*b*. But, a gap 158 is defined between the end segment 154 and the base segment 152 of the side wall 124*a*. When the side walls 124 have been crimped over the wire end 26, the sealing wing 156 extends within the gap 158. As can be seen in FIG. 9, the sealing wing 156 is folded over itself within the gap 158. Optionally, the end segment 155 of sealing wing 156 is engaged with the base segment 157 of the sealing wing 156. The sealing wing 156 thereby facilitates sealing the gap 158 to facilitate preventing moisture from entering the opening 125 of the crimp barrel 120 through the contact end 132 after the crimp barrel 120 has been crimped over the wire end 26.

The engagement between the end segment 154 and the base segment 152 of the side wall 124*b* also facilitates preventing moisture from entering the opening 125 of the crimp barrel 120 through the contact end 132 after the crimp barrel 120 has been crimped over the wire end 26. Optionally, the segment 157 of the sealing wing 156 extends from the side wall 124*a* in a direction generally away from the base 122 of the crimp barrel 120 after the side walls 124 have been crimped over the wire end 26. The sealing wing 156 optionally engages an interior surface 146 of base segment 152 and/or the end segment 154 of the side wall 124*a* when the side walls 124 are crimped over the wire end 26. As can be seen in FIG. 9, when the side walls 124*a* and 124*b* have been crimped over the wire end 26 such that the side walls 124*a* and 124*b* are folded over (e.g., as shown in FIG. 9), the end segments 154 of the side walls 124*a* and 124*b* are engaged with each other.

The sealing wing 156 and/or a combination of the sealing wing 156 and sealant facilitates sealing the contact end 132 of the crimp barrel 120 to thereby facilitate preventing moisture from entering the opening 125, from contacting the conductors 30 and/or the interior surfaces 144 and/or 146 of the crimp barrel 120, from entering an interface between the conductors 30 and interior surfaces 144 and/or 146 of the crimp barrel 120, and/or the like. In some embodiments, no portion of the conductors 30 of the wire 28 is exposed through the contact end 132 of the crimp barrel 120 when the crimp barrel 120 has been crimped around the wire end 26. The length that the sealing wing 156 extends outwardly from the side wall 124*a* may be selected such that the sealing wing 156 occupies a predetermined amount space at the contact end 132 of the crimp barrel 120. For example, and as should be apparent from the Figures, the length of the sealing wing 156 is longer than the lengths of the sealing wings 56 to accommodate using a single sealing wing 156 instead of a plurality of sealing wings 56.

Optionally, no portion of the conductor(s) 30 extends past the contact end 132 of the crimp barrel 120 after the crimp barrel 120 has been crimped around the wire end 26. The sealing provided by the sealing wing 156 and/or any sealant thereby facilitates preventing moisture from contacting the conductor(s) 30 as compared to terminals wherein a conductor end sticks out past the contact end of a crimp barrel and/or terminals wherein a conductor is exposed through an opening within the contact end of a crimp barrel.

Figure 10:
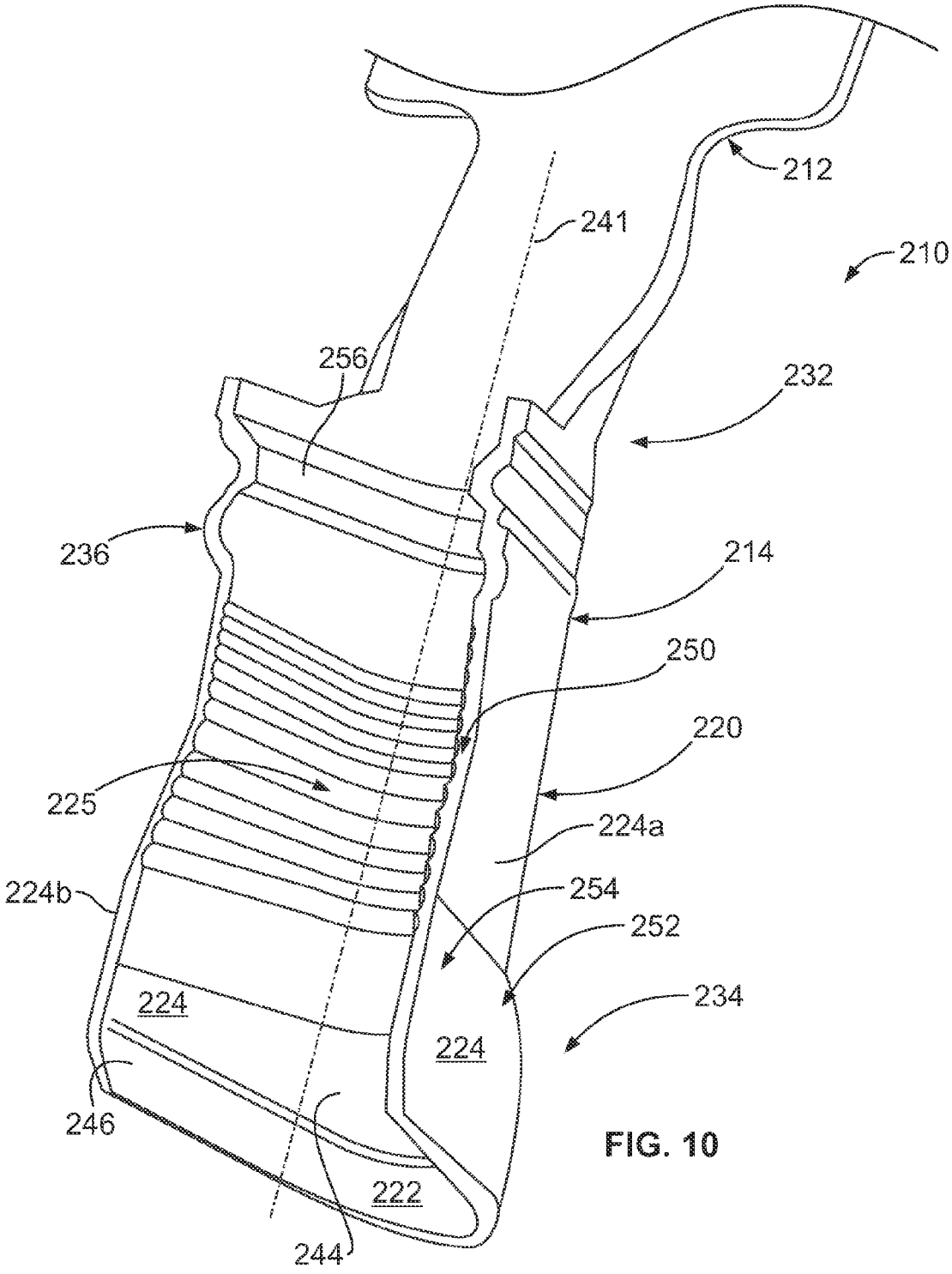
FIG. 10 is a perspective view of another exemplary alternative embodiment of an electrical terminal.

FIG. 10 is a perspective view of an exemplary alternative embodiment of an electrical terminal 210 illustrating a crimp barrel 220 that includes an embossment 256 to facilitate sealing a contact end 232 of the crimp barrel 220. The terminal 210 includes an electrical contact segment 212 and a crimp segment 214 that extends from the electrical contact segment 212. The crimp segment 214 includes the crimp barrel 220, which is configured to be crimped around the end 26 (FIG. 6) of the wire 28 (FIGS. 3, 5, and 6) to mechanically and electrically connect the wire 28 to the electrical terminal 210. The crimp barrel 220 includes a base 222 and opposing side walls 224 that extend from the base 222. An opening 225 of the crimp barrel 220 is defined between the base 222 and the side walls 224. The crimp barrel 220 extends a length from the contact end 232 to a wire end 234 and includes a front seal crimp sub-segment 236. The side walls 224 include base segments 252 that extend from the base 222 and end segments 254 that extend from the base segments 252 and include ends 250 of the side walls 124. The embossment 256 may be referred to herein as a "sealing wing".

The front seal crimp sub-segment 236 includes the embossment 256, which extends outwardly from interior surfaces 244 and 246 of the base 222 and side walls 224, respectively. In other words, the embossment 256 extends outwardly from the interiors surfaces 244 and 246 and radially inwardly relative to a central longitudinal axis 241 of the terminal 210. In the exemplary embodiment, the embossment 256 extends continuously along the interior surfaces 244 and 246 from the end 250 of one of the side walls 224 to the end 250 of the other side wall 224. Alternatively, the embossment 256 extends only partially along the interior surfaces 244 and 246 between the ends 250, including embodiments where the embossment includes at least two segments that are not interconnected.

After the crimp barrel 220 has been crimped around the wire end 26, the side walls 224 have been crimped over the wire end 26 such that the side walls 224 are folded over. When the side walls 224 are folded over, the segment of the embossment 256 that extends along the end segment 254 of the side wall 224*a* is engaged with the segment of the embossment 256 that extends along the base segment 252 of the side wall 224*a*. Similarly, the segment of the embossment 256 that extends along the end segment 254 of the side wall 224*b* is engaged with the segment of the embossment 256 that extends along the base segment 252 of the side wall 224*b*. When the side walls 224*a* and 224*b* are folded over, the end segments 254 of the side walls 224*a* and 224*b* are engaged with each other. The ends 250 of the side walls 224*a* and 224*b* optionally engage the interior surface 244 of the base 222.

The embossment 256 and/or a combination of the embossment 256 and sealant facilitates sealing the contact end 232 of the crimp barrel 220 to thereby facilitate preventing moisture from entering the opening 225, from contacting the conductors 30 and/or the interior surfaces 244 and/or 246 of the crimp barrel 220, from entering an interface between the conductors 30 and interior surfaces 244 and/or 246 of the crimp barrel 220, and/or the like. In some embodiments, no portion of the conductors 30 of the wire 28 is exposed through the contact end 232 of the crimp barrel 220 when the crimp barrel 220 has been crimped around the wire end 26. A length that the embossment 256 extends outwardly from the interior surfaces 244 and 246 may be selected such that the embossment 256 occupies a predetermined amount space at the contact end 232 of the crimp barrel 220. Optionally, no portion of the conductor(s) 30 extends past the contact end 232 of the crimp barrel 220 after the crimp barrel 220 has been crimped around the wire end 26. The sealing provided by the embossment 256 and/or any sealant thereby facilitates preventing moisture from contacting the conductor(s) 30 as compared to terminals wherein a conductor end sticks out past the contact end of a crimp barrel and/or terminals wherein a conductor is exposed through an opening within the contact end of a crimp barrel.

The embodiments described and/or illustrated herein provide an electrical terminal that may be less likely to experience electrochemical corrosion on one or more conductors of a wire terminated by the electrical terminal, on interior surfaces of the electrical terminal, at an interface between the conductor(s) of the wire and the interior surfaces of the electrical terminal, and/or the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical terminal for terminating a wire, the electrical terminal comprising:

an electrical contact; and a crimp barrel extending from the electrical contact, the crimp barrel being configured to be crimped around an end of the wire, the crimp barrel comprising a base and opposing side walls that extend from the base, the base and side walls defining an opening of the crimp barrel that is configured to receive the end of the wire therein, the side walls extending outwardly from the base to ends, the side walls comprising base segments that extend from the base and end segments that extend from the base segments and include the ends, a sealing wing extends from the end of at least one of the side walls, the side walls being configured to be folded over when crimped over the end of the wire such that a gap is defined between the end segment and the base segment of at least one of the side walls, wherein the sealing wing is configured to extend within the gap between the end segment and the base segment of the corresponding side wall when the side walls are crimped over the end of the wire.

2. The electrical terminal of claim 1, wherein the crimp barrel extends a length from a contact end, which extends from the electrical contact, to a wire end, and wherein when the crimp barrel has been crimped around the end of the wire, the side walls and the base of the crimp barrel define a continuous enclosure that extends entirely around the end of the wire from the contact end to the wire end of the crimp barrel.

3. The electrical terminal of claim 1, wherein the crimp barrel includes a contact end that extends from the electrical contact, the sealing wing being configured to seal the contact end of the crimp barrel when the side walls are crimped over the end of the wire.

4. The electrical terminal of claim 1, wherein the sealing wing extends from the corresponding side wall in a direction generally toward the base of the crimp barrel before the side walls are crimped over the end of the wire.

5. The electrical terminal of claim 1, wherein the wire includes at least one conductor, the side walls comprising interior surfaces that engage at least one of the at least one conductor of the wire when the side walls are crimped thereover, the sealing wing engaging the interior surface of at least one of the base segment and the end segment of the corresponding side wall when the side walls are crimped over the wire.

6. The electrical terminal of claim 1, wherein the wire includes at least one conductor and an electrical insulation layer, the crimp barrel extending a length from a contact end, which extends from the electrical contact, to a wire end that is configured to engage the electrical insulation layer of the wire, and wherein no portion of the at least one conductor extends past the contact end of the crimp barrel after the crimp barrel has been crimped around the end of the wire.

7. The electrical terminal of claim 1, wherein the sealing wing is configured to be folded over itself within the gap when the side walls are crimped over the end of the wire.

8. The electrical terminal of claim 1, wherein at least a portion of the sealing wing extends approximately parallel to the corresponding side wall before the side walls are crimped over the end of the wire.

9. The electrical terminal of claim 1, wherein the electrical terminal further comprises sealant held within the opening of the crimp barrel.

10. The electrical terminal of claim 1, wherein the electrical terminal further comprises a sealant extending within the gap defined between the end segment and the base segment of the at least one side wall when the side walls are crimped over the end of the wire.

11. The electrical terminal of claim 1, wherein a pocket is defined between the sealing wing and the corresponding side wall before the side walls are crimped over the end of the wire, the pocket comprising a sealant held therein.

12. The electrical terminal of claim 1, wherein the crimp barrel extends a length from a contact end to a wire end, and wherein when the crimp barrel has been crimped around the end of the wire, at least a portion of the crimp barrel tapers outwardly as the crimp barrel extends from the contact end to the wire end.

13. An electrical terminal for terminating a wire having at least one conductor and an electrical insulation layer, the electrical terminal comprising:

an electrical contact; and a crimp barrel extending from the electrical contact, the crimp barrel being configured to be crimped around an end of the wire, the crimp barrel comprising a base and opposing side walls that extend from the base, the base and side walls defining an opening of the crimp barrel that is configured to receive the end of the wire therein, wherein when the crimp barrel has been crimped around the end of the wire, the side walls and the base of the crimp barrel define a continuous enclosure that extends entirely around a circumference of the end of the wire from the electrical insulation layer of the wire and past an end surface of the at least one conductor.

14. The electrical terminal of claim 13, wherein the crimp barrel extends a length from a contact end to a wire end, the side walls and the base extending continuously from the contact end to the wire end.

15. The electrical terminal of claim 13, wherein the crimp barrel extends a length from a contact end to a wire end, the side walls extending outwardly from the base to ends, the side walls comprising base segments that extend from the base and end segments that extend from the base segments and include the ends, wherein when the crimp barrel has been crimped around the end of the wire, the end segments of the side walls are engaged with each other along an entirety of the length of the crimp barrel from the contact end to the wire end.

16. The electrical terminal of claim 13, wherein the crimp barrel extends a length from a contact end to a wire end, the wire end being sealed with the electrical insulation layer of the wire when the crimp barrel has been crimped around the end of the wire, the contact end being sealed when the crimp barrel has been crimped around the end of the wire such that no portion of the at least one conductor of the wire is exposed through the contact end when the crimp barrel has been crimped around the end of the wire.

17. The electrical terminal of claim 13, wherein the crimp barrel extends a length from a contact end to a wire end, and wherein no portion of the at least one conductor of the wire is exposed between the contact and wire ends of the crimp barrel.

18. The electrical terminal of claim 13, wherein the crimp barrel extends a length from a contact end to a wire end, and wherein no portion of the at least one conductor extends past the contact end of the crimp barrel after the crimp barrel has been crimped around the end of the wire.

19. The electrical terminal of claim 1, wherein the crimp barrel extends a length from a contact end to a wire end, the electrical terminal further comprising a sealant to facilitate sealing at least one of the contact end or the wire end.

20. An electrical terminal for terminating a wire, the electrical terminal comprising:

an electrical contact; and a crimp barrel extending from the electrical contact, the crimp barrel being configured to be crimped around an end of the wire, the crimp barrel comprising a base and opposing side walls that extend from the base, the base and side walls defining an opening of the crimp barrel that is configured to receive the end of the wire therein, the side walls and base comprising interior surfaces, an embossment extends outwardly from at least one of the interior surface of the base or the interior surface of at least one of the side walls, the side walls being configured to be folded over when crimped over the end of the wire such that a gap is defined between the end segment and the base segment of at least one of the side walls, wherein the embossment includes a segment that is configured to engage another segment of the embossment within the gap between the end segment and the base segment of the corresponding side wall when the side walls are crimped over the end of the wire.

* * * * *